United States Patent [19]

Bachmann

[11] 4,022,123

[45] May 10, 1977

[54] GARBAGE COMPACTOR

[75] Inventor: Hans Bachmann, Lenzburg, Switzerland

[73] Assignee: Soder A.G. Maschinenfabrik, Lenzburg, Switzerland

[22] Filed: Dec. 23, 1975

[21] Appl. No.: 643,958

[52] U.S. Cl. ..... 100/229 R; 100/255; 100/269 R

[51] Int. Cl.[2] ..... B30B 15/00; B30B 15/04; B30B 15/16

[58] Field of Search ..... 100/229 R, 229 A, 255, 100/240, 269 R, 269 B

[56] References Cited

UNITED STATES PATENTS

| | | | |
|---|---|---|---|
| 3,635,152 | 1/1972 | Olmsted | 100/269 B |
| 3,752,066 | 8/1973 | Charles | 100/269 R |
| 3,754,503 | 8/1973 | Hennells | 100/229 A |
| 3,805,690 | 4/1974 | Goldkuhle | 100/229 A |
| 3,807,294 | 4/1974 | Ligh | 100/269 R |
| 3,888,171 | 6/1975 | Eckerle | 100/229 A |

FOREIGN PATENTS OR APPLICATIONS

| | | | |
|---|---|---|---|
| 421,060 | 3/1947 | Italy | 100/255 |

*Primary Examiner*—Richard E. Aegerter
*Assistant Examiner*—Richard R. Stearns
*Attorney, Agent, or Firm*—Mason, Fenwick & Lawrence

[57] ABSTRACT

A garbage compactor has a rigid frame structure with a lower horizontal base plate, an upper horizontal top plate connected by three interconnecting vertical bars. An octagonal container positioned between the base plate and top plate is pivotally connected to and slidable on one of the interconnecting bars to swing outwardly for loading and unloading with a hydraulic cylinder on the top plate operating to compress garbage in the container. A hinged wall section of the container is operable to permit removal of a bag insert when filled with compacted garbage.

6 Claims, 6 Drawing Figures

GARBAGE COMPACTOR

BACKGROUND OF THE INVENTION

1. Field of the Invention

Garbage in a household, hotel, factory, hospitals and the like often cause severe problems, on the one hand in view of its storing, on the other hand in view of the removal of the garbage. It is known that these problems can be considerably lessened by using a garbage compressing device, a so called compactor. The ideal operating site of such compactor would lie in the individual household itself, where there is a constant flow of garbage but only limited storage room and where the garbage has to be stored sometimes for quite a long time until it can be removed. Such a garbage compactor should therefore meet several requirements: First — it should be constructed in a very compact way, so that it could be built into the kitchen-board without requiring much more room than an ordinary garbage bag. Secondly — it should be possible to manufacture such garbage compactor in a simple and consequently, non-expensive way, so that everybody could afford to buy one. Thirdly — it should be very powerful, so that any kind of garbage typical for a household can be tightly compacted. Last but not least, the use and servicing of such a device should be simple and effortless.

2. Description of the Prior Art

Several types of garbage compactors are already known, but none of them meet all the requirements stated above. Frequently, such a device comprises a container for the storing of the garbage, which container is provided with a tightly fitting insert made of, e.g., stiff paper. This garbage compactor furthermore comprises ram shaft equipment, where the ram has a cross-section corresponding to the interior of the container. This mostly used type of garbage compactor is usually built into a separate metal or wood cabinet which exhibits a door in front. This door is usually designed as a folding door or as an ordinary swinging door, whereby the garbage container is fixed on the inner side of the door. The movement of the ramshaft is achieved by several kinds of power transmissions, i.e., mechanical, hydraulical or electrical power transmissions and sources. All these known types of garbage compactors have the great disadvantage that they need ample room, so that often the mounting and use of such devices is excluded by a shortage of room. A further disadvantage is the tiresome removal of the garbage bags which easily can weigh more than 60 pounds. In addition to that, the handling and servicing of such devices tends to be time wasting and troublesome, so that quite often they are not used at all or at least not fully exploited.

SUMMARY OF THE INVENTION

The aim of the present invention is to propose a garbage compactor which exhibits none of the above mentioned disadvantages, which is compactly built, manufactured at a low price level and which is easy to manipulate. In addition to that, the garbage which is fed into the device can be of any kind and the removal of the filled garbage bags can be easily done.

The proposed garbage compactor according to the invention comprises a container for the storage of the garbage, which container is covered on its inner side with a tightly fitting insert, e.g., of stiff paper. It furthermore comprises a ramshaft which in its cross-section corresponds to the interior of the container and which can be pressed down into the container by means of a pressure generating device. According to the invention, the garbage compactor is provided whith a lower horizontal base plate and an upper horizontal top plate, the two plates being connected to each other by means of rigid bars. The top plate represents a carrier for the pressure generating subassembly. The container is pivotally fixed on one of the bars, so that it may be swung around the bar and displaced along the bar. The invention is furthermore characterized by the special construction of the container itself. One side of this container is constructed as a flap which can be opened like a door. This flap guarantees an effortless removal of the fully packed garbage bags. A favoured construction example exhibits a container of octogonal crosssection, comprising four wider sides and four small sides. Two bearings are attached on one of the small sides of the container and to one of the bars, thus enabling the container to be swung around this bar. Both bearings are rigidly fixed on the container but are displaceable along the bar. The resting position of the container is determined by a spring on the bar below the lower bearing. The container normally does not touch the lower plate because of the action of the spring which lifts the container upwards by pushing the lower bearing upwards. Thus, the container may be turned outwards effortlessly against the low friction of the bearings. On the other hand — if the ramshaft is being pressed down into the container — the bearing is protected against excessive torque because the spring is being compressed until the container rests on the lower plate. The pressure generating subassembly may comprise for instance a piston-cylinder unit which exhibits a piston with a large upper and a smaller lower active area thereby defining a large upper and a smaller lower working volume. This enables a slow but forceful downward movement of the piston and a less forceful but fast upward movement without changing the power of the hydraulic pump.

The pressure generating subassembly furthermore comprises an electrically powered motor driving a fluid pump, a regulating valve, a pressure-release valve and a balancing receptacle for the hydraulic fluid. This balancing receptacle is arranged concentrically around the cylinder of the piston cylinder unit thus allowing for a very compact construction of least possible height.

BRIEF DESCRIPTION OF THE DRAWINGS

In the following a preferred embodiment of the invention is explained in detail with reference to the accompanying drawings.

DESCRIPTION OF A PREFERRED EMBODIMENT

Figure 1:
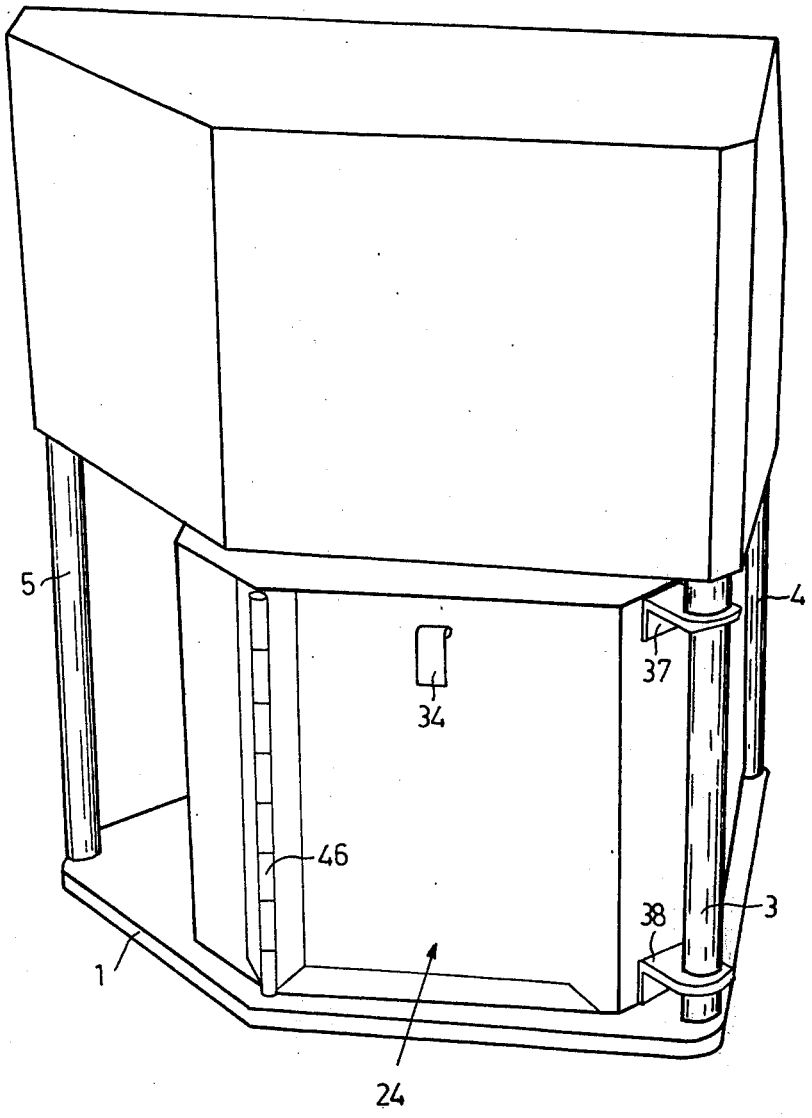
FIG. 1 shows a perspective view of the garbage compactor with the garbage container in its resting position.
Figure 2:
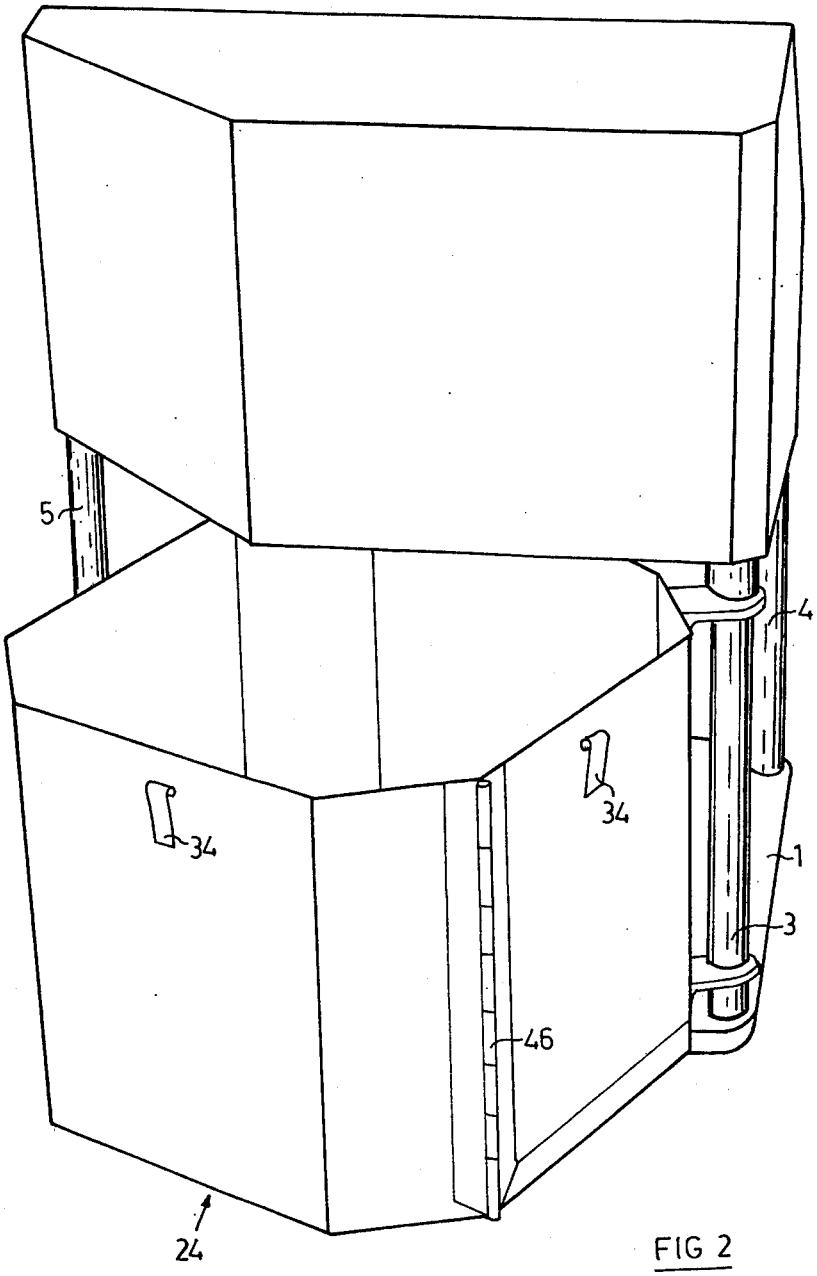
FIG. 2 shows a perspective view of the garbage compactor with the garbage container turned outwards.
Figure 3:
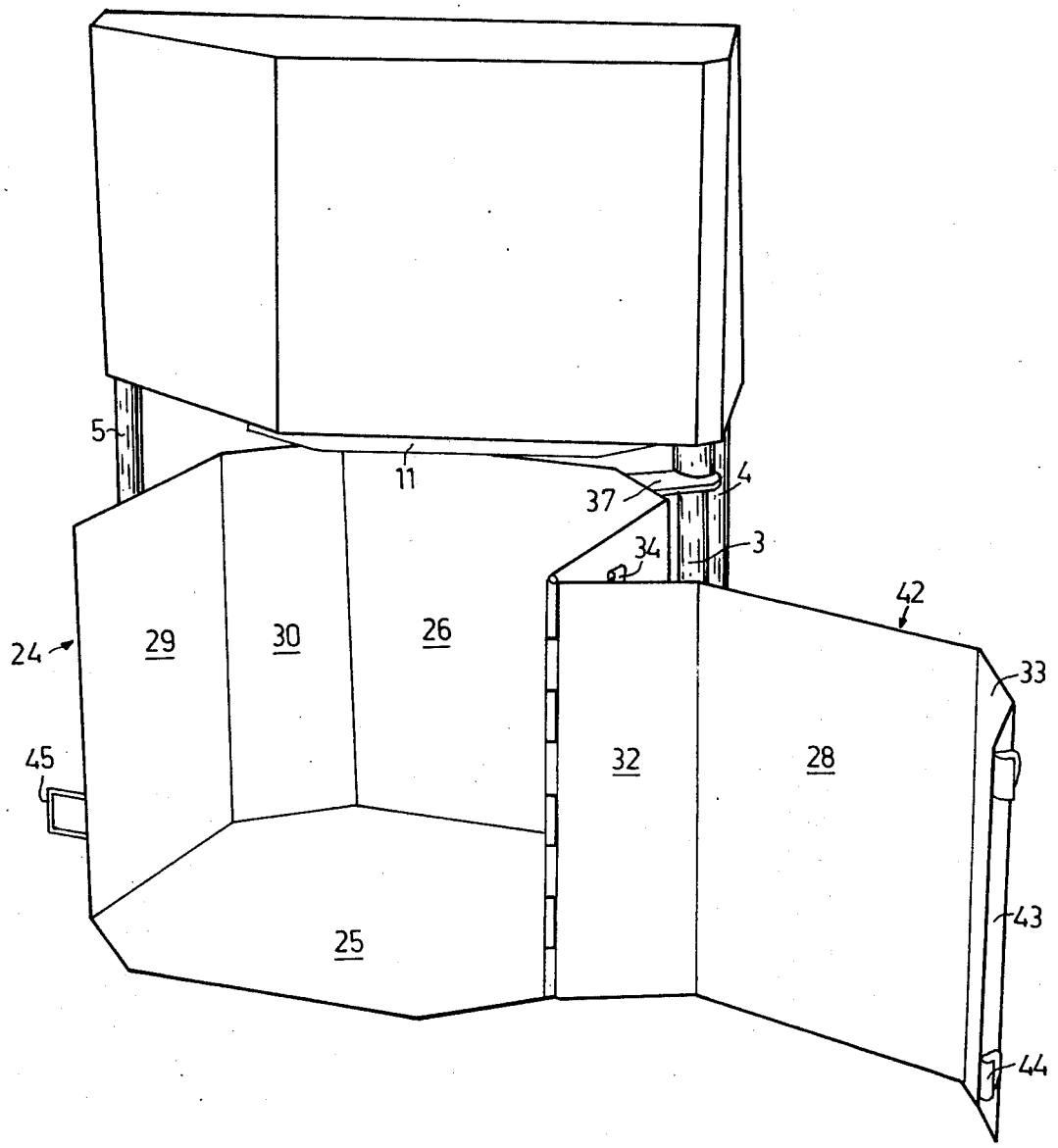
FIG. 3 shows a perspective view of the garbage compactor with the flap opened.
Figure 4:
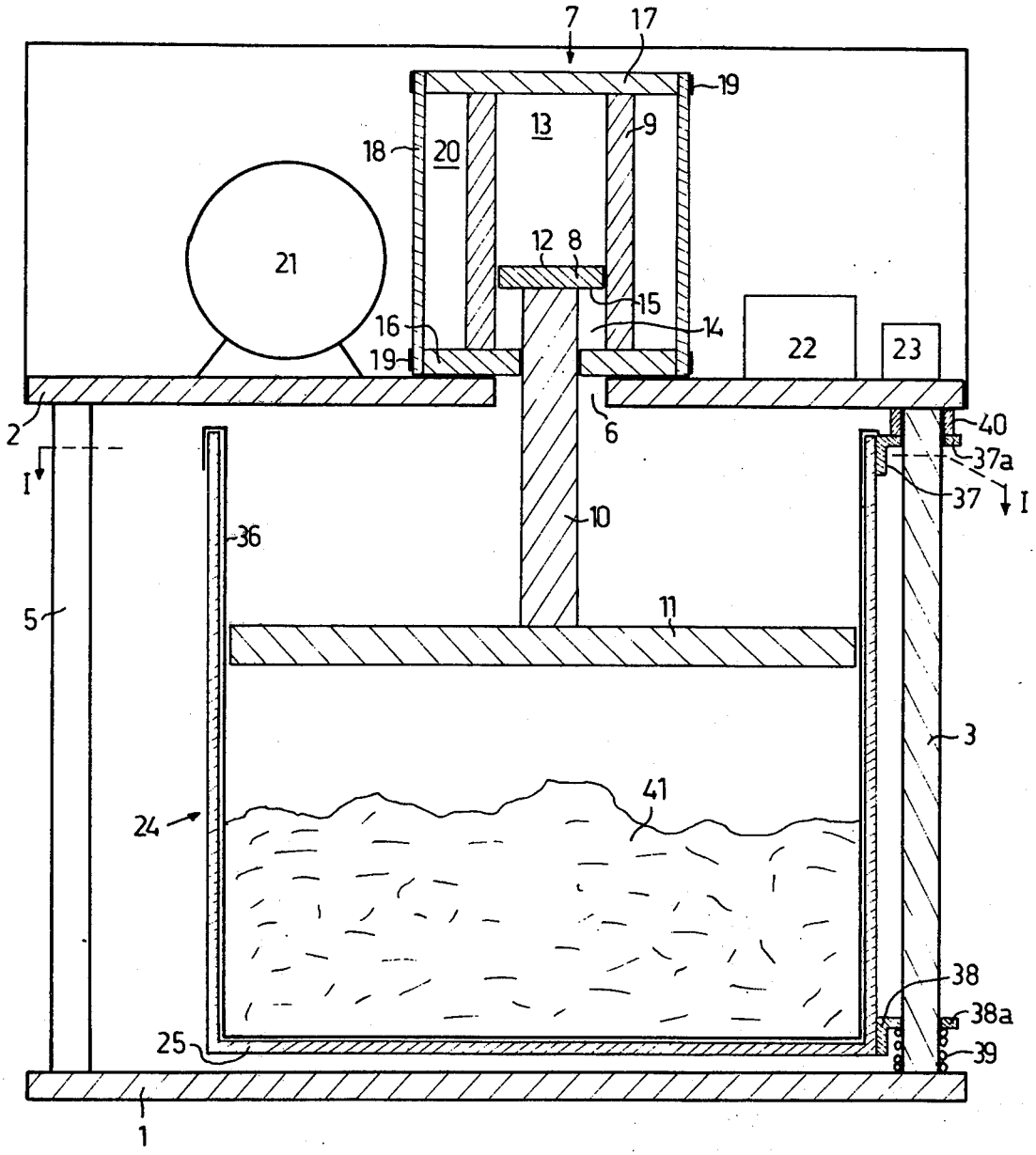
FIG. 4 shows a vertical cross-section of the compactor according to FIG. 1–3.

The garbage compactor, according to FIG. 1–6, comprises a base plate 1 preferably in the form of a heavy thick steel plate. A second plate 2, a similarly thick and heavy top steel plate, is arranged parallel to the base plate 1 and at a predetermined distance from it. The two plates 1 and 2 are connected to each other by means of three carrier bars 3 to 5. The bars 3 to 5 are hollow or massive steel members with circular cross section. The elements 1 to 5 thus form a rigid and strong basic structure.

A pressure generating subassembly is arranged on the top of the plate 2. It comprises a cylinder piston unit 7, mounted above a circular opening 6 in the top plate 2. It comprises a piston 8 moving in a cylinder 9 which piston 8 is connected by a shaft 10 to a compactor ram 11. The cylinder is separated into two working chambers, a larger one 13 determined by the upper larger active surface 12 of the piston 8 and the top of the cylinder 9 and a smaller working chamber 14 determined by the lower smaller active surface 15 of the piston 8 and the bottom of the cylinder 9. The top respectively bottom plates 17 and 16 are of greater diameter than the cylinder 9. The outer edges of these two plates 17 and 16 are surrounded by a cylindrical casing 18 which is fixed to said plates 17 and 16 by two stretchers 19. The space 20 which is thus formed and which lies concentrically to the cylinder 9 serves as a balancing receptacle for the hydraulic fluid. Several pipings lead to this receptacle 20 and to cylinder 9 as parts of the hydraulic system. They are not shown in FIG. 4 for the sake of simplicity. An electrical motor serves as pressure source 21, together with a fluid pump. This pressue source 21 is mounted on the carrier plate 2, too. Smilarly, regulating valve 22 and a pressure release valve 23 are fixed likewise on the carrier plate 2.

Figure 5:
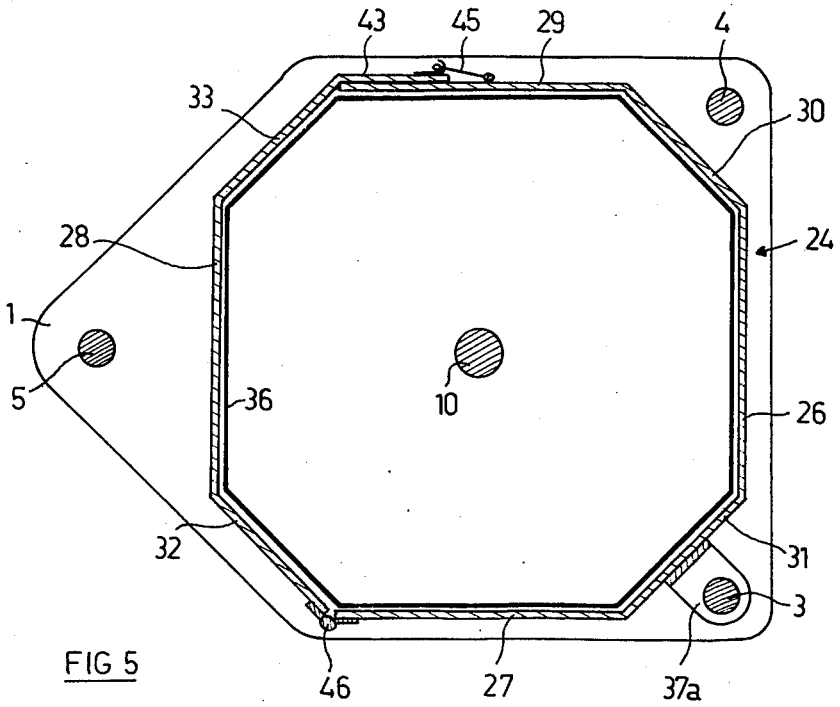
FIG. 5 shows a horizontal cross-section along the line I — I in FIG. 4.

The space between the base plate 1 and the carrier plate 2 is occupied by a garbage receiving container generally designated by 24. This container 24 is of octogonal cross-section as can be seen in FIG. 5. The container 24 consists of a bottom section 25, four wider wall sections 26 to 29 and four smaller wall sections 30 to 33. The four wider wall sections 26 to 29 include clamps 34 which are fixed on their outer sides in the middle of the wall sections 26 to 29 below their upper edge. These clamps 34 serve as attaching means for a tightly fitting liner insert 36. The upper rim of this insert 36 is folded over the edge of the container 24 and fixed by the clamps 34.

The wall section 31 is provided on both its lower and upper end with two carrier members 37 and 38 which comprise a vertical part fixed to the container 24 and a horizontal part 37*a* and 38*a*. These two horizontal parts 37*a* and 38*a* serve as bearings for the swivel connection of the container 24 to the bar 3. In the embodiment shown in FIG. 4 the bearings are simply constructed by a circular opening in the horizontal parts 37*a* and 38*a* corresponding to the diameter of the bar 3. Thus, the container may be turned around the bar 3 and is displaceable along said bar. Below the lower horizontal part 38*a* and around the bar 3, a spring 39 is provided which rests on the base plate 1 and which pushes the lower carrier part 38*a* upwards as long as no pressure is applied to the garbage by the compressor ram 11. The upper resting position of the container 24 is defined by a spacer member 40 which is inserted between the carrier plate 2 and the upper carrier part 37*a*. The force of the spring 39 and the length of spacer member 40 relative to the length of the bar 3 is chosen in such a way that the bottom of the container 24 does not touch the base plate 1 even if the container is full of garbage. On the other hand, as soon as pressure is applied to the garbage by the compressor ram 11, the spring 39 yields and the container 24 comes to rest on the base plate 1. It is thus guaranteed that the rigid structure formed by the members 1 to 5 accepts all the forces generated by the compressor ram 11 while the force acted upon the carrier members 37 and 38 corresponds to the relatively small force of the spring 39. It is therefore possible to apply heavy pressure upon the garbage which has been proven to be necessary for the wrecking of small bottles as they are used for certain beverages. If no pressure is applied to the garbage and the compressor piston is withdrawn from the container 24, the container 24 may be turned outwards quite effortlessly against the small friction of the two horizontal parts 37*a* and 38*a* against the bar and against the spring 39 respectively the spacer member 40.

The container 24 is provided with a door 42. This door is formed by one of the wider wall sections 28 and the two adjacent small wall sections 32 and 33. One of these small wall sections 33 includes a continuation 43 which lies parallel to the wall section 29, provided the door is closed and which is provided with two hooks 44. These two hooks 44 correspond to two catches 45 only one of which is illustrated in the drawings attached to the wall section 29. The catches and the hooks function as a locking mechanism. This arrangement enables the container to be opened over its full width. Therefore, the tiresome lifting of the full garbage bags which easily can weigh over 60 pounds, over the edge of the container is not necessary anymore, because the bag now can slide laterally out of the container 24.

Figure 6:
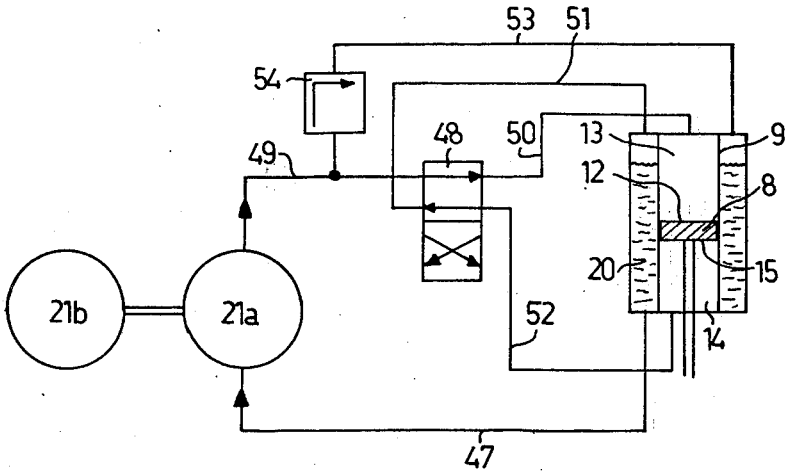
FIG. 6 shows a functional diagram of the hydraulic system.

FIG. 6 shows the construction of the hydraulic system. An electrically powered motor 21*b* drives a fluid pump 21*a*. The suction inlet of the pump 21*a* is connected by a pipe 47 to the balancing receptacle 20 which receptacle 20 lies circumjacent to the cylinder 9. The regulating valve 48 is connected to the high pressure outlet of the pump 21*a* by the pipe 49. A further pipe 50 connects the regulating valve 48 to the upper working chamber 13 of the cylinder 9. The lower working chamber 14 is connected to the regulating valve 48 by the pipe 52 and the balancing receptacle 20 by the pipe 51. A pressure release valve 54 protects the system and connects the pressure pipe 49 to the balancing receptacle 20 in case of excessive pressure via pipe 53.

In the situation shown in FIG. 6 the regulating valve 48 connects the lower working volume 14 to the balancing receptacle 20 and the high pressure outlet of the pump 21*a* to the upper working volume 13. In this situation, the piston 8 is pressed downwards as the upper working chamber 13 expands by the hydraulic fluid which is pressed from the pump 21*a* through the pipes 49 and 50. At the same time the hydraulic fluid in the lower working chamber 14 is pressed through the pipes 51 and 52 into the balancing receptacle 20. The piston 8 acts by means of the shaft 10 upon the compressor ram 11 which in turn is pressed down upon the garbage 41. The other position of the regulating valve 48 shows the inverse situation: The high pressure outlet of the pump 21*a* is now connected to the lower working chamber 14 by the pipes 49 and 52 and the upper working chamber is connected through the pipes 50 and 51 to the balancing receptacle 20. The piston 8 is moved upwards out of the container by the hydraulic fluid flowing from the pump 21*a* through the pipes 49 and 52 into the lower working chamber 14 while the hydraulic fluid in the upper working chamber 13 is pressed into the balancing receptacle 20 through the pipes 50 and 51. This upward movement is much faster than the downward movement because of the small active piston surface 15 in the lower working chamber 14.

The pressure release valve 54 limits the pressure, defining thus the maximum pressure applieable upon the garbage 41. In the case of pressure limitation the valve 54 opens and hydraulic fluid flows directly from the pump 21*a* through the pipes 49 and 53 to the balancing receptacle 20.

The present invention represents a garbage compactor of small outer dimensions which can easily be built into an existing kitchen board instead of an usual garbage container. The simple yet strong construction of this garbage compactor enables a low cost manufacture. The removal of the fitted garbage bags is effortless as there is no need to lift the bags over the edge of the container 24. The pressure applied upon the garbage is high while the fast retraction of the compressor ram guarantees a short duty cycle of the device.

Finally, it should be mentioned that a mechanical switch can be provided which cuts the electrical power of the motor and which for instance is switched by a wall of the container 24 connecting the power to the motor only, if the container wall touches the switch. Thus, no compression is possible while the container 24 is moved outward. The device is therefore protected against faulty manipulation.

What I claim is:

1. A garbage compactor comprising:

a rigid frame structure including essentially a lower horizontally arranged base plate, an upper horizontally arranged top plate and at least three interconnecting bars fixedly connecting said top plate to said base plate in parallel relationship to said base plate at a fixed distance therefrom;

a garbage container arranged between said base plate and said top plate including a fixed wall section, a movable wall section, means pivotally connecting said movable wall section to said fixed wall section for enabling said fixed wall section to pivot about a vertical axis between a closed position and an open position in the manner of a door, connector means pivotally connecting said garbage container to one of said interconnecting bars so that said container is supported by said one of said interconnecting bars, said connecting means permitting said garbage container to be displaced vertically a small amount along said one of said interconnecting bars wherein the fixed wall section and the movable wall section are of octagonal configuration as viewed from above when said movable wall section is in its closed position, said wall sections consisting of four wider wall parts and four smaller wall parts, said connector means comprising an upper carrier member extending outwardly from one of said smaller wall parts and a lower carrier member extending outwardly from said one of said smaller wall parts, a circular opening provided in said carrier members positioned over said one of said interconnecting bars;

a pressure generating subassembly arranged on top of said top plate and a vertically movable compactor ram connected to said pressure generating subassembly; and wherein said compactor ram corresponds in its cross-section to the interior shape of said garbage container and is displaceable into said garbage container and out of said garbage container by actuation of said pressure generating subassembly.

2. A garbage compactor according to claim 1 wherein said movable wall section consists of one of said wider wall parts and two adjacent wall parts respectively positioned along opposite sides and joined to said wider wall part.

3. A garbage compactor according to claim 2 additionally including biassing means urging said garbage container upwardly for normally maintaining said garbage container a slight distance above the top of said base plate.

4. A garbage compactor as recited in claim 3 additionally including a tubular spacer means on said one of said interconnecting bars for engaging said upper carrier for limiting the upper position of said garbage container, said biasing means comprising a spring inserted between the bottom of said lower carrier member and the top of said base plate so that said spring provides an upward urging force against said lower carrier member to urge said garbage container in an upward direction.

5. A garbage compactor according to claim 4 in which said pressure generating subassembly includes a source of pressurized fluid, a piston and cylinder unit having a piston rod extending downwardly through an aperture in said horizontally arranged top plate.

6. A garbage compactor according to claim 5 in which said source of pressurized fluid includes an electric motor, a hydraulic pump connected to and driven by said electric motor, a hydraulic pump connected to and driven by said electric motor, said pump having an outlet and an inlet, a balancing receptacle coaxially positioned around said piston and cylinder unit, a first pipe extending between said outlet to a control valve operable for supplying pressurized fluid selectively to one or the other sides of said piston of the piston and cylinder unit, a second pipe extending between said inlet and said balancing receptacle and a pressure relief valve connected in a pipe extending between said first pipe and said balancing receptacle for relieving excess pressure in said first pipe.

* * * * *